US007448826B2

(12) United States Patent
Laury

(10) Patent No.: US 7,448,826 B2
(45) Date of Patent: Nov. 11, 2008

(54) MODULAR DEVICE FOR SIMULTANEOUSLY SPREADING CUT FIBERS AND BINDERS AND A SPREADING MACHINE

(75) Inventor: Jérôme Laury, East Grinstead (FR)

(73) Assignee: Colas, Boulogne-Billancourt (FR)

( * ) Notice: Subject to any disclaimer, the term of this patent is extended or adjusted under 35 U.S.C. 154(b) by 296 days.

(21) Appl. No.: 11/174,644

(22) Filed: Jul. 6, 2005

(65) Prior Publication Data

US 2006/0034653 A1 Feb. 16, 2006

(30) Foreign Application Priority Data

Aug. 2, 2004 (FR) ..... 04 51755

(51) Int. Cl.
*E01C 19/18* (2006.01)

(52) U.S. Cl. ..... 404/100; 404/101; 404/108; 404/111

(58) Field of Classification Search ..... 404/100, 404/101, 108, 111
See application file for complete search history.

(56) References Cited

U.S. PATENT DOCUMENTS 3,819,291 A * 6/1974 McConnaughay ..... 404/75
5,407,139 A * 4/1995 Mleczewski ..... 241/18
5,730,549 A * 3/1998 Choudin et al. ..... 404/75

FOREIGN PATENT DOCUMENTS

| | | | |
|---|---|---|---|
| EP | 0 356 284 | * | 7/1989 |
| EP | 0 360 695 | * | 9/1989 |
| EP | 0 456 502 | | 11/1991 |
| FR | 2 661 929 | | 11/1991 |
| FR | 2 735 798 | * | 12/1996 |

* cited by examiner

*Primary Examiner*—Gary S Hartmann
(74) *Attorney, Agent, or Firm*—Young & Thompson

(57) ABSTRACT

A device for simultaneously spreading cut fibers and binders on a roadway width, includes, in the longitudinal direction, a first binder spreading set, a second cut fiber spreading set and a third binder spreading set, the second set including cutting tools, which are driven by a torque transmission member. The device is modular, the modules being transversally arranged side by side and each allowing to spread on a longitudinal lane of the roadway binders and cut fibers. Each module has a first nozzle, a tool for pulling and cutting continuous fibers and throwing cut fibers to the roadway, a second nozzle, the nozzles being connected to a common binder dispensing member. Each tool is removably mounted in its module between a working position where it is in the module and driven by the driving shaft and a releasing position where it is available to an operator and at rest.

16 Claims, 6 Drawing Sheets

Figure 1:
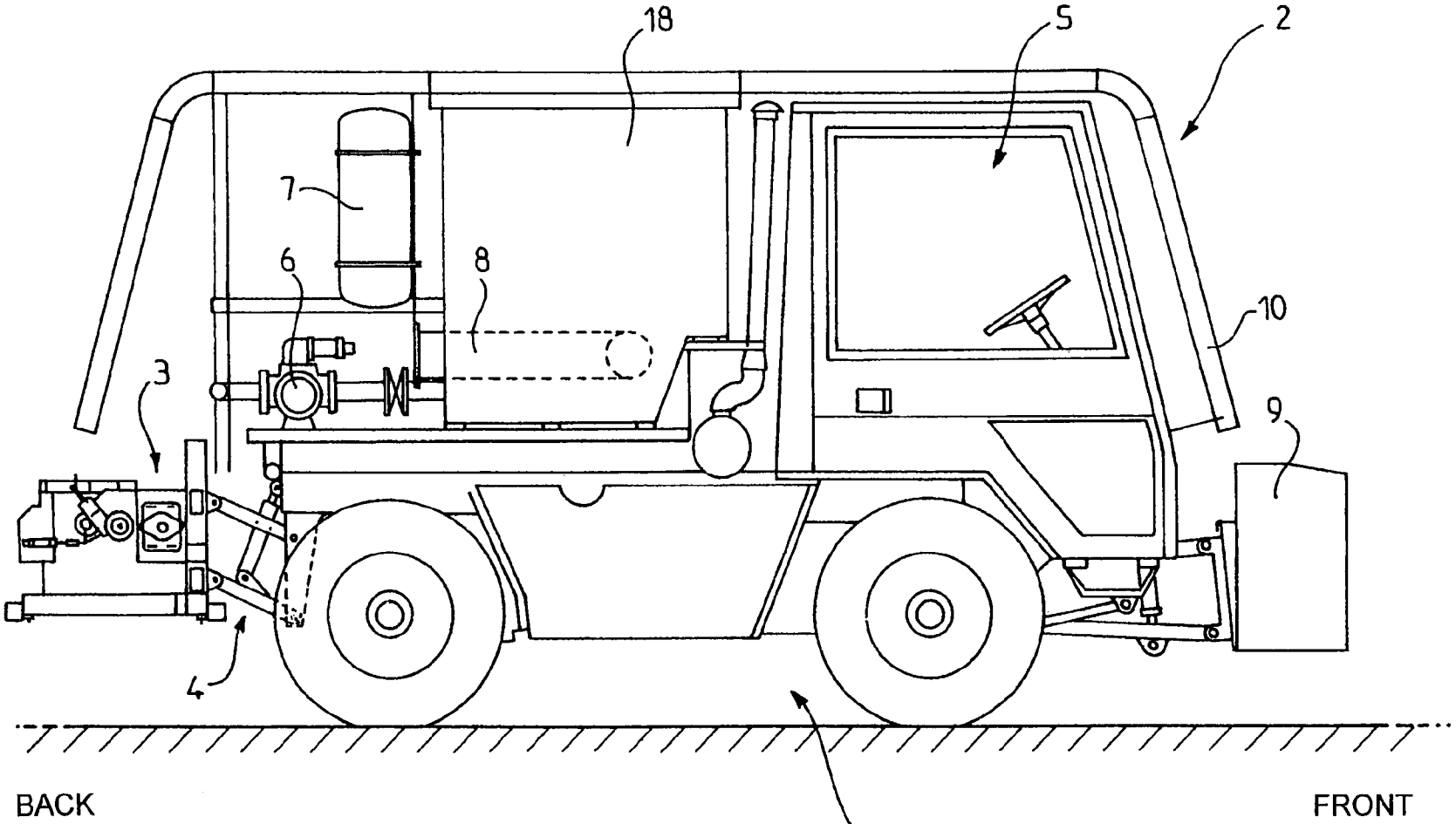

MODULAR DEVICE FOR SIMULTANEOUSLY SPREADING CUT FIBERS AND BINDERS AND A SPREADING MACHINE

FIELD OF THE INVENTION

The present invention relates to a modular device for simultaneously spreading cut fibers and binders on a roadway and to a spreading machine comprising such a device. It finds application in the field of civil engineering and, more particularly, in building and repairing roadways, including for automobiles, but it could find applications for any type of ground coating such as, for example, runways, harbour quays, sport surfaces, parking places, cycle paths . . . .

BACKGROUND OF THE INVENTION

In the field of traffic roadway building or repairing, a method is known for adding cut fibers in a binder allowing to structure the binder layer so as to withstand tearing due to the traffic or to transversal stresses or to restrict cracking propagations. Such a method comprises nearly simultaneously spreading in the forwarding direction of a spreading system, a binder layer followed by a cut fiber layer, in turn coated with a second binder layer. Such an operation is generally followed by coating such layers with mineral or naturally occurring or synthetic granulates in order to allow for the traffic to run. The binder is generally a bitumen emulsion.

Such systems comprise continuous fiber-cutting bars provided with cutters in a number different from the number of bitumen emulsion spreading sprays which does not allow the supplying or spreading width to be varied without risking to compromise the performance of the method.

Such existing spreading systems do not allow for a reliably transversally dispensing fibers, a necessary requirement for the feasability and durability of such methods.

As to the flow rates, the existing systems allow for mean flow rates of 60 grammes/$m^2$ of cut fibers and, more preferably, of 90 grammes/$m^2$ of cut fibers at the most because of the technology being used. In addition, the cutter rotative speed, beyond a certain limit, make them inoperative as fibers curl about the cutters without being nevertheless cut, making the maintenance difficult all the more as this requires the full dismantling of the fiber cutting set, handling heavy and bulky mechanical parts, sometimes hazardous for the operator. This physical limitation of the cutting speed makes it impossible to increase the fiber flow rate through increasing the cutting tool speed.

SUMMARY OF THE INVENTION

Finally, the known systems require complex settings and skilled and/or numerous labour during such spreading operations for monitoring and setting. There could also result in spreading unevenness on the sites.

The present invention provides specially solving such problems with a device for simultaneously spreading cut fibers and a binder on a roadway width, the device comprising, in the longitudinal from front to back direction, a first binder spreading set, a second cut fiber spreading set and a third binder spreading set, the second set comprising tools allowing to at least cut continuous fibers, said tools being driven by a torque transmission member.

According to the invention, the device is modular, the modules being arranged transversally side by side and each allowing to spread on a longitudinal lane of the roadway binders and cut fibers, each module comprising from front to back:

for the first set, a first nozzle for spreading binders, for the second set, a tool allowing pulling continuous fibers, cutting continuous fibers and throwing the cut fibers to the roadway, for the third set, a second nozzle for spreading binders, the first and second nozzles being connected to a common member for dispensing binders, the transmission member is a transversally arranged rotative driving shaft and running across said modules, and each of such tools is removably mounted in its module between a working position where it is in the module and driven by the driving shaft and a releasing position where it is available to an operator and at rest.

The term <<binders>> means both the binders as such, as well as binder associations with other members such as powders, sands, even granulates, either ready-to-use stored, or mixed in use. It is understood that in such a case, the spreading means and more specifically, the nozzles and/or the pump and/or the means for storing binders and optional other members and mixers will be adapted accordingly.

In various embodiments according to the invention, the following means able to be used either alone or according to all the technically possible combinations, are used:

removably mounting the tool occurs rotatively, the tool being upwardly released from the module, the tool comprises a first axis able to be rotatively engaged on the driving shaft and bearing a cutting roller, a second axis bearing a pressing roller intended to hold the continuous fiber in contact with the cutting roller and a third axis bearing a holding roller allowing to hold the continuous fiber on the pressing roller upstream the cutting roller, each nozzle provides for a fanned out binder jet substantially on the longitudinal lane of the roadway corresponding to the module, operating the torque transmission member is performed by a hydraulic motor arranged in the device, each module is approximately 100 mm wide, the length of the cut fibers can be set, the length of the cut fibers can be set according to at least three sizes approximately corresponding to 30, 60 and 120 mm, the cut fiber flow rate can be set by controlling the rotation speed of the driving shaft, rotatively mounting the tool in its module additionally allows a rest position where the tool being in the module, the tool is not driven by the driving shaft, switching from the working position to the rest position occurs under the control of a remote controlled actuator and the first and second nozzles comprise upstream on the common dispensing member at least one remote controlled valve allowing to cut off or not spreading binder through both nozzles, the actuator and the valve control being common so as to allow or not simultaneously spreading cut fibers and binders for a given module, the module comprises a first hinge allowing to switch the tool from the rest position to the working position and a second hinge allowing to switch the tool from the rest position to the releasing position, the device comprises at least two parts, a first part comprising a first module set and a second part comprising a second module set, both parts being movable one relative to the other between a high width mode and a reduced width mode, (allows to process a higher roadway width in the high width mode while allowing for a reduced space to be used apart from the roadway processing operations in the reduced width mode, for example for conveying the device between sites)

the device is foldable, moving two parts between one another occurs through rotation, in the high width mode, both parts being aligned as well as their respective driving shafts being functionally interlocked in rotation, and in the reduced width mode, one of the two parts being tumbled relative to the other and the driving shafts being functionally separated, the device is telescopic, moving both parts therebetween occurs through translation, the device is foldable and telescopic.

The invention relates also to a machine for simultaneously spreading cut fibers and binders on a roadway width, said machine being an automotive road vehicle with a driving and control station, comprising a device according to any or more of the above listed features as well as at least: one binder tank, a means for fluidizing said binders, a means for pressurizing said binders for directing towards the device nozzles, a continuous fiber supply, an air compressor and a pressurized air supply intended at least for overpressurizing the modules, said vehicle providing power for actuating the torque transmission member of the device.

In various embodiments of the machine, the following means able to be used either alone or according to all the technically contemplated combinations, are used:

the air compressor and the pressurized air supply are those of the road vehicle, the means for pressurizing said binders allow for a pressure in the binder common dispensing member generally ranging in operation from about 0.5 $10^5$ and 0.8 $10^5$ Pa (0.5 and 0.8 bars), the means for pressurizing said binders is a pump being set by a controlling device, the pressurized air is in addition intended for pressurizing said binders, the binder tank comprises a stirring means allowing to homogenize said binders, the binder tank comprises a binder recirculating circuit (more specifically in the case of implementing a pump, through the pump redirecting part of the binders towards the binder tank)

the pressurized air is additionally intended in the module for throwing the cut fibers towards the roadway, the pressurized air is further intended for supplying pneumatic power to the actuators, the pressurized air is additionally intended for a device for applying binders and fibers manually of the hand hose type, the device is located at the back of the machine, the supply of continuous fibers comprises a fiber reel set, the continuous fiber supply is fixed to the device, the continuous fiber supply is arranged on the machine, the continuous fiber supply is arranged on the machine on a position being easily available for replacing fiber reels and enhancing a load distribution on the frame of the machine, the continuous fiber supply is arranged at the front of the machine, the continuous fibers are conveyed from the supply to the device through lines, the lines run on the top of the machine, the device is coupled on the machine by means of a controlled movable coupling device allowing for a spreading position, the device being then close to the roadway, and a conveying position, the device being then away from the roadway, the controlled movable coupling device further allows for a lateral offset of the device relative to the vehicle, the controlling operations are performed under an operator's supervision in the driving station or from a panel located outside the driving station, the panel located outside the driving station comprises a simplified control, the vehicle is of the four driving wheel type and allows for a spreading speed of between about 2 and 5 km/h for dispensing cut fibers between 0 and 200 grammes/$m^2$ of roadway and a binder flow rate ranging from about 0 to 3.5 litres/$m^2$, the machine comprises means allowing to ensure substantially constantly spreading binders and cut fibers despite variations in the moving speed and the number of operational modules (spreading width), the machine comprises a radar for measuring the moving speed, the means for fluidizing binders is a heating means, the binder fluidizing means is a heating means with a fuel burner, the fuel is selected amongst fuel oil or gas or the like, and preferably, light fuel oil, the burner is automatic, the means for fluidizing binders is an electrical heating means, the machine has two parts with a trailer coupled to the road vehicle comprising at least the driving and control station, the trailer comprising at the least the spreading device, (any member distribution, including the binder tank, the fiber supply . . . between the trailer and the road vehicle is considered, more specifically depending on the road vehicle type already comprising some or all or none of the subject members, for example a binder conveying truck with its tank, a standard truck, etc), the machine has two parts with a trailer coupled to the road vehicle comprising at least the driving and control station, the trailer comprising at the least the spreading device and the continuous fiber supply, (preferably the trailer comprises the spreading device and the fiber supply, the other members being located on the road vehicle), in such a case, the two part machine with a trailer coupled to a road vehicle, said road vehicle is standard, the trailer comprising at least: the device coupled to the trailer, the binder tank, the means for fluidizing said binders, the means for pressurizing said binders for directing towards the device nozzles, the continuous fiber supply, the air compressor and the pressurized air supply, in the case where the trailer does not comprise any driving power source, the road vehicle supplies power for actuating the torque transmission member of the spreading device.

The system and the machine according to the invention therefore comprise a number of cutters (continuous fiber cutting tools) identical to the number of lines of emulsion jets (there are two jets per line and per cutting tool) allowing to reach amounts up to 200 grammes/$m^2$ of fibers, or even more. It allows for a more homogeneous transversal dispensing of the fibers with an accuracy being in all points within a 10% deviation, on the roadway width being processed through spreading. The modular structure allows for variations in the processing width while maintaining the fiber and binder proportioning on the width being processed. Such a modularity also allows for an increased mechanical availability and an easy maintenance. Using mostly easily dismantled and easy to handle equipments further improves an easy maintenance In addition to the easy availability of all the mechanical members because of the modularity, each tool can be dismantled individually and is available in a few seconds for cleaning, adjusting, replacing the cutting blades or for a replacement through standard part exchange. By virtue of its structure, the hazard risks during maintenance are reduced as the tools are no longer functional when they are available.

The system and the machine allow for large flow rate variations both for cut fibers as for the binder, this being independent for the selection of the fiber/binder ratio and being dependent for a constant spreading of the material despite possible variations in the spreading speed and in changes of the working width.

Thus, the invention allows to reach an increased reliability and repetitiveness, a steadfastness in terms of respecting the objectives, the applied amounts, while providing for possibilities to adapt large volume variations. Additionally, the reduced pressure value of the binder for ejecting through the nozzles compared to the known systems allows for a considerable decrease in the parasitic emissions and splashings evaluated up to about 50%.

Finally, such a modular system is easily adapted in various widths while maintaining the same structure.

BRIEF DESCRIPTION OF THE INVENTION

Figure 2:
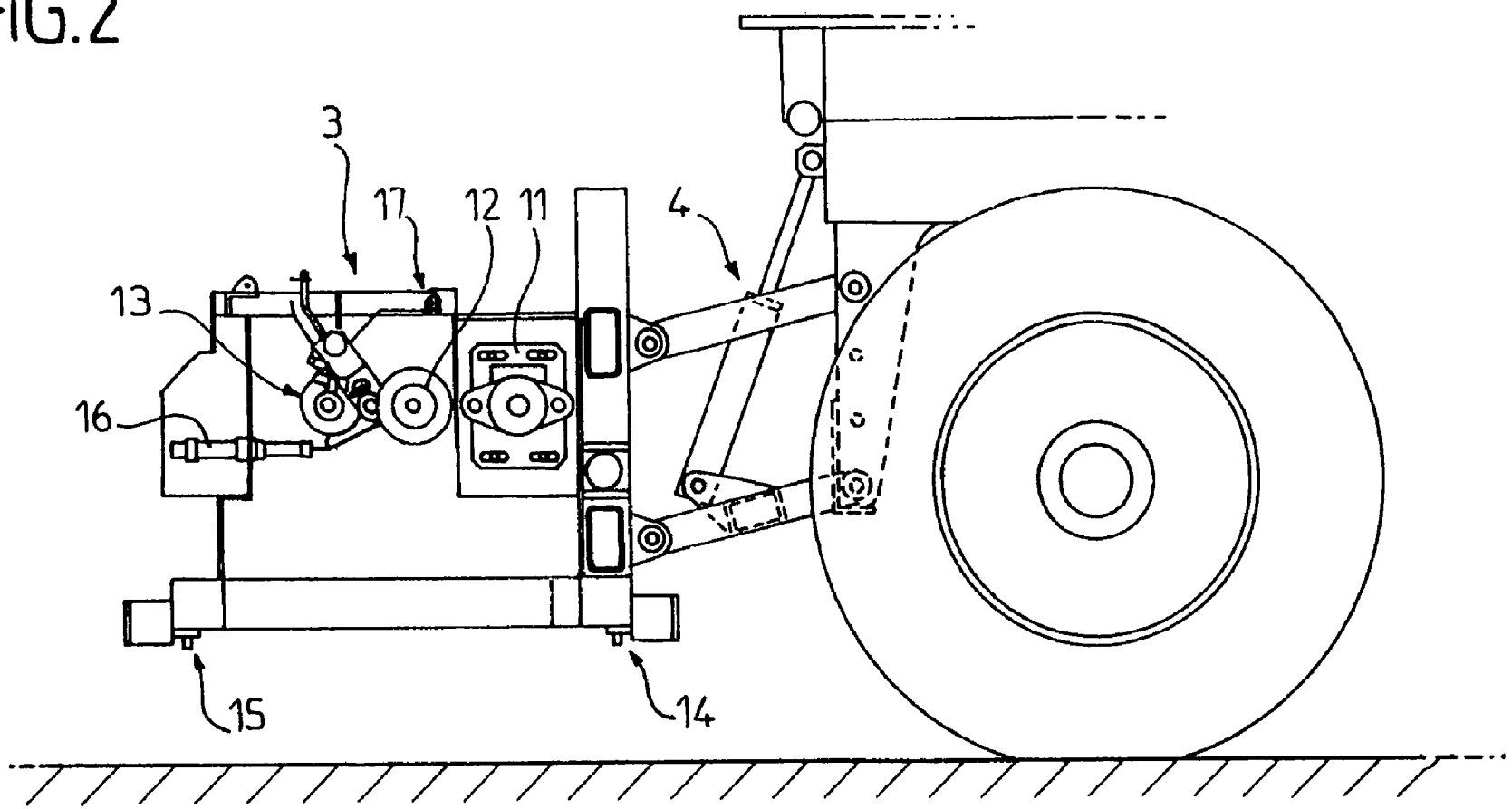
Figure 3:
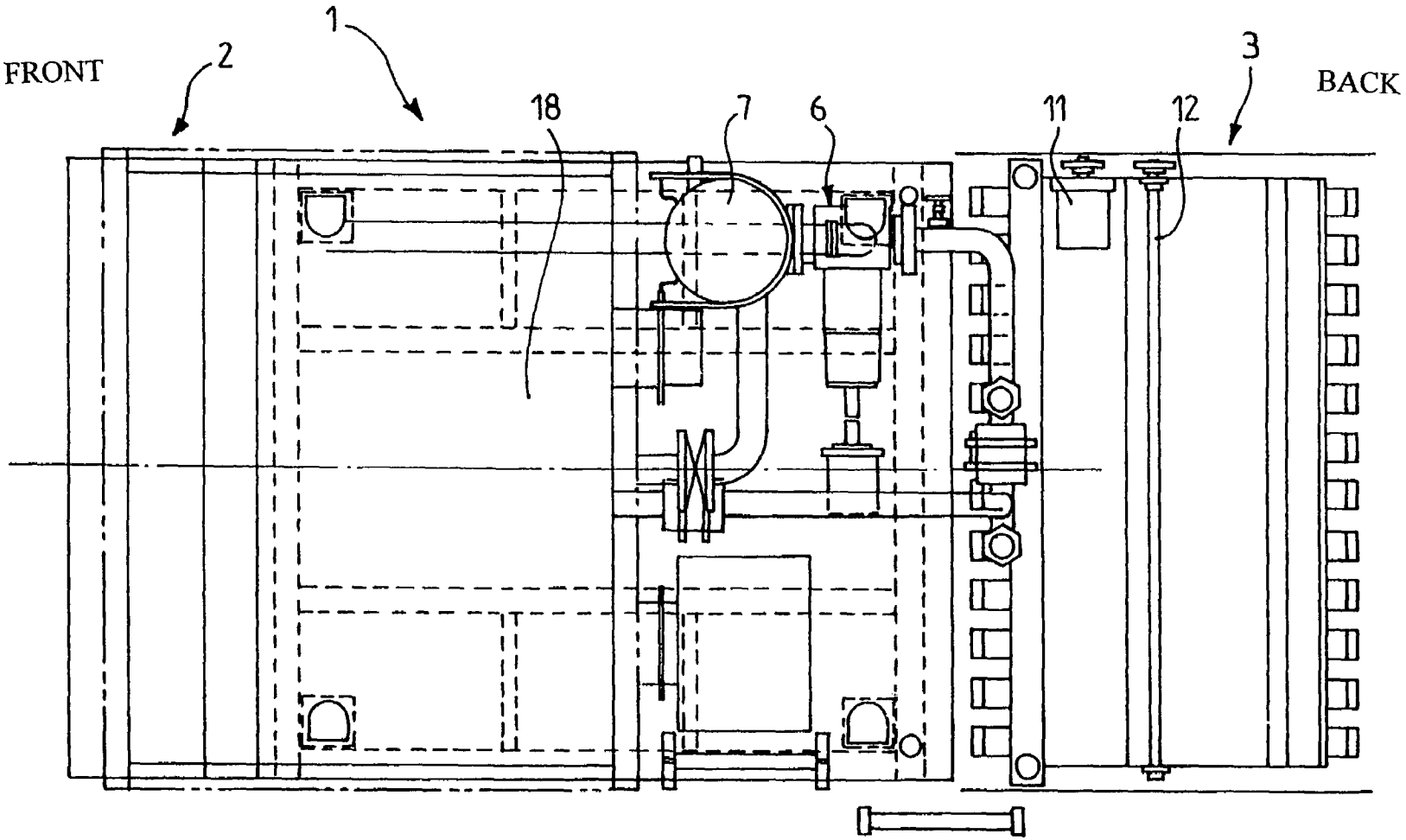
Figure 4:
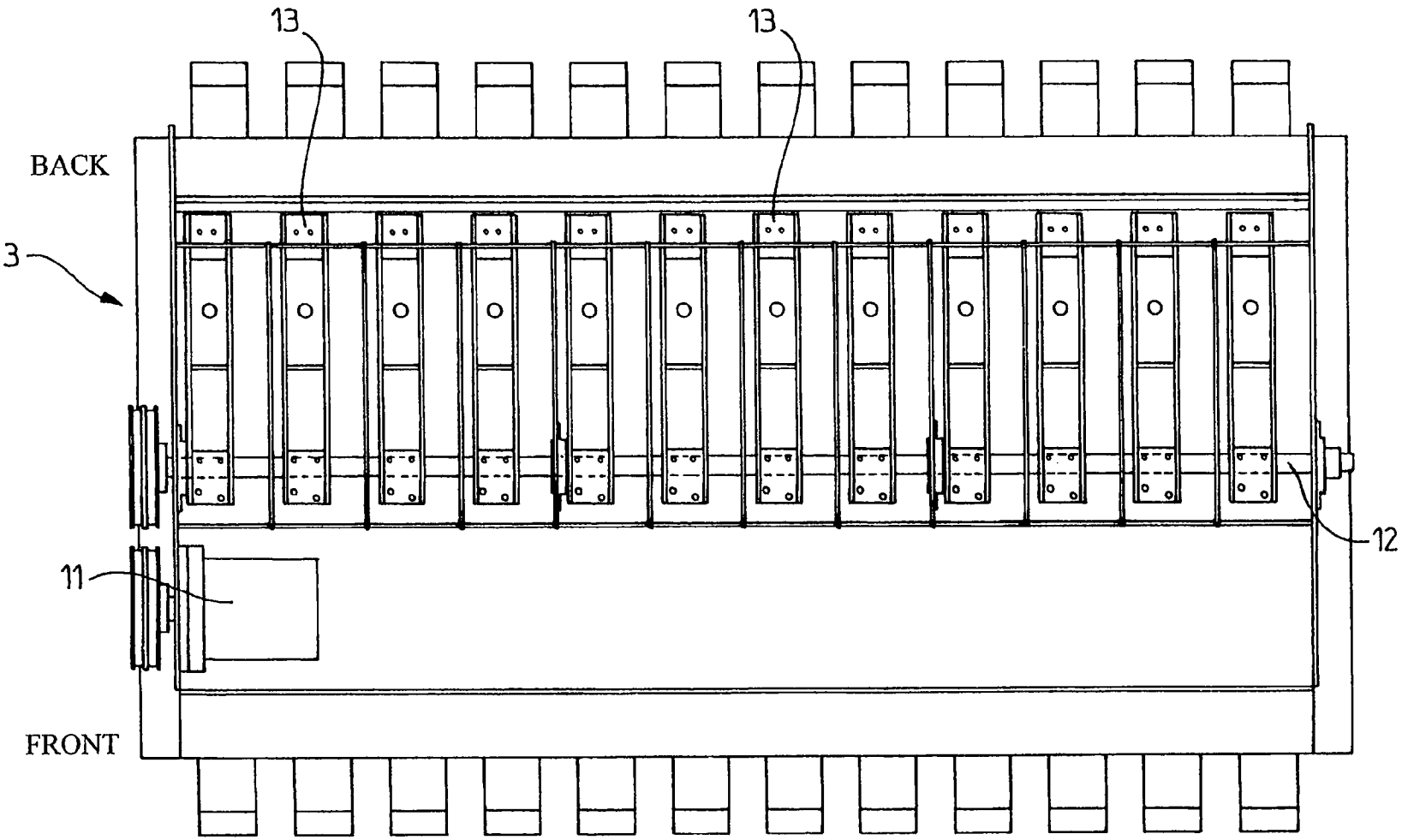
Figure 5:
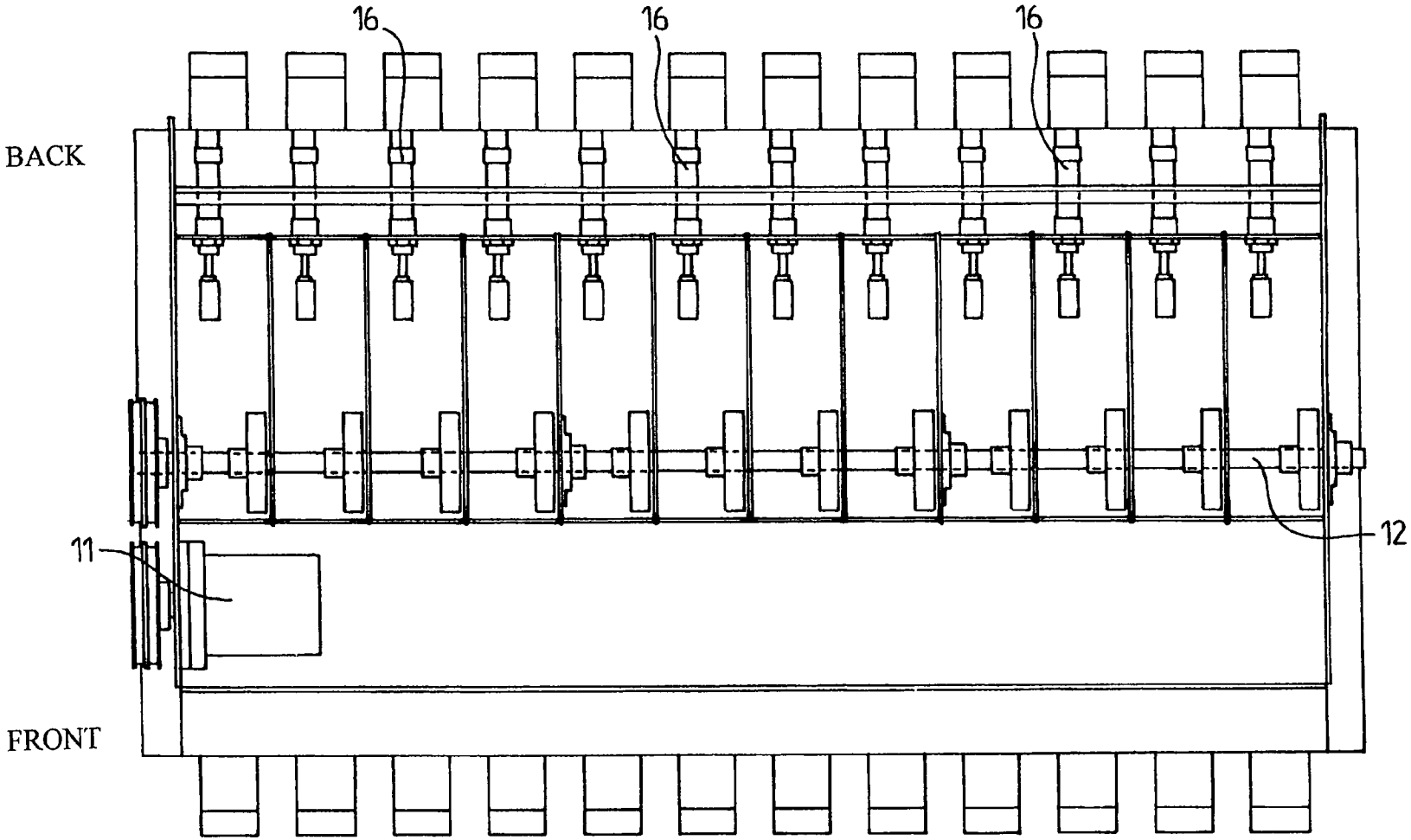
Figure 6:
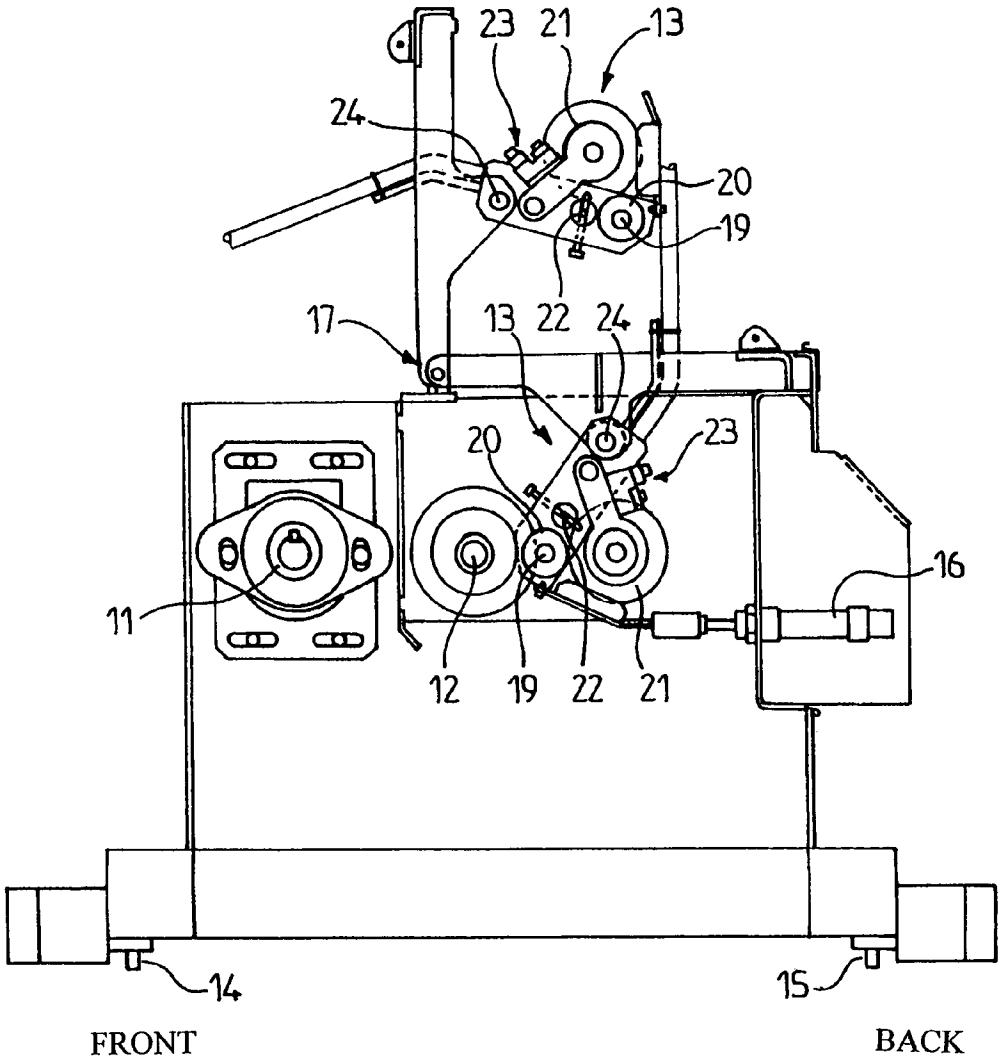

The present invention will be now exemplified without any limitation with the following description in conjunction with the following figures:

FIG. 1 illustrating a side view of a machine with the spreading device being lifted for conveying between sites, FIG. 2 illustrating a side view of the back of a machine with the spreading device being lowered in a spreading position, FIG. 3 illustrating a top view of a machine with the spreading device, FIG. 4 illustrating a first top view of the spreading device, FIG. 5 illustrating a second top view of the spreading device, FIG. 6 illustrating a side view of the spreading device at the level of a module with tools in a working position and a releasing position.

DETAILED DESCRIPTION OF THE INVENTION

In FIG. 1, an embodiment of the invention is presented as a machine comprising a four driving wheel automotive road vehicle 2 with, at the front, a driving and control cabin 5 for an operator. On the front of the cabin 5 is arranged a supply 9 of continuous fiber reels in a hooded trunk 9 being at an available height so that an operator having opened the hood could install them and replace them once they are unwound. In an embodiment (not shown), the trunk 9 is arranged at the front with a suspension intended to mitigate the effects of the unevenness of roadways at the level of the trunk 9. A set of lines 10 makes it possible to feed continuous fibers towards the back of the vehicle, in the spreading device 3, passing on the top of said vehicle. In other embodiments, the continuous fibers can pass to the back in a different way and, for example, through side, or even lower lines.

The machine, as will be seen, comprises an air compressor with a pressurized air tank. In order to direct from the front (reel supply trunk) to the back (modules with tools) passing through the line, a new continuous fiber from a new reel once the previous reel is exhausted and replaced by an operator, the latter manually engages the end of the continuous thread of the new reel into the front opening of the line and then, using an airgun, directs pressurized air through said front opening, creating a front-back air stream in the line which drives the continuous fiber to the modules. Once the thus driven continuous fiber gets out through the back opening of the line, the latter is grabbed by the corresponding tool, the latter being in a working position, and the operator can then stop the pressurized air blow in the line.

The vehicle 2 has an engine consuming liquid fuel of the light fuel oil type. A vessel/tank 18 with a capacity of about 1,000 litres for, preferably bitumen, binders occupies the frame part at the back of the cabin 5. The vessel comprises a hatch at the top thereof for filling. A heating means is used for fluidizing binders as a heater 8, preferably automatic, using light fuel oil being tapped from the fuel tank of the vehicle. It should be noted that in alternatives (not shown), the heating could occur by means of gas, heavy fuel oil or any fuel substance, even by means of electricity.

On the back of the vehicle and on the frame thereof is further located a pump 6 for pressuring binders as well as a pressurized air tank 7, with a capacity of about 30 litres, produced by an air compressor, preferably the vehicle own air compressor. A part of the binders passing through the pump can be redirected to the tank for recirculation. In an alternative (not shown), the binder pressurization could be achieved with pressurized air.

The spreading device 3 is arranged at the back of the vehicle frame by means of a controlled movable coupling device 4. The controlled movable coupling device is, on FIG. 1, lifted in a conveying position, the device being then away from the roadway. The coupling device could also be set in a spreading position, the device being then close to the roadway, as this will be subsequently seen relating to FIG. 2. Preferably, the movable coupling device further allows for a lateral offset of the device 3. Adapted coupling means are implemented between the spreading device and the vehicle so as to allow for the passage of binders, of pressurized air, of continuous fibers, of the energy and of the control and monitoring circuitry in order to be able to follow the vertical shifts and the side translation shifts of the device 3 between its working position and conveying position. In particular, the device 3 receives binders pressurized by the pump 6 through at least one flexible line not shown here. Similarly, the pressurized air in the tank 7 is directed to the device 3 through flexible lines. Finally, continuous fibers leaving the lines 10 for reaching the device 3 are intrinsically flexible and can be pulled from the reels.

The spreading device 3 being shown transversally on FIG. 1, comprises a set of modules each comprising two nozzles for throwing binders on the roadway and arranged at the front and at the back of a tool allowing to pull continuous fibers, to cut them and to spread them on the roadway.

The machine with the vehicle comprising the device at the back and the continuous fiber supply at the front has the following approximate dimensions: total length 4,750 mm, total width 1,300 mm, total height 2,300 mm, spreading width 1,200 mm. The operative weight of the machine is approximately 4,750 kg and it can travel from site to site at a maximum speed of about 40 km/hr. A automated monitoring system of the micro-computer type with a display screen allows an operator in the driving cabin of the vehicle to select operating modes (stop of some modules, respective flow rates of binders and/of cut fibers, progression speed . . . ), to monitor and regulate the operation of the machine (flow rates, more specifically depending on the progression speed, regulating the binder heating . . . ), to notify faults and to supply reports of the operational activity of the machine.

In the illustrated example, the device has 12 tools with cutters and 12 lines of binder jets (2 nozzles and therefore 2 jets per line). For such a machine operating in a maximum width of 1.20 m, but allowing to operate at lower widths per pitch of 100 mm (width of a module), stopping some modules (stopping the tool and the two corresponding jets), it is possible to vary the cut fiber flow rate under control and at request between 0 and up to about 200 grammes/$m^2$ while maintaining a homogeneous transversal distribution which does not produce any deviation higher than 10%. It is understood that the flow rate indications as given in the present application are indicative as they more specifically depend on the progression speed of the device. In addition, the machine capacities as well in storing, flow rate, speed, autonomy and the like, could vary depending on the structures at all levels between machines for important work with a high working width comprising a large number of modules and therefore also large storing volumes for a satisfactory autonomy and machines with more reduced capacities.

Controlled valves are implemented in the fluidic binder circuit in order to be able to cut off the binder supply of each module (2 nozzles) individually, on request. Preferably, all the modules are kept in overpressure by pressurized air, even those not being functional so as to avoid emulsion vapour being redirected to the tools. The module overpressurizing could also have a favourable effect on the downward ejection of the cut fibers, the modules being only downwards opened in a working position (and, preferably also in a rest operation by means of a double hinge of the tools) and the air stream only be able to escape downwards. In an alternative, controlled valves could be provided for the pressurized air in each module. Means for regulating the pressure in the binder fluidic circuit acting on the pump 6 and/or for the pressurized air can also be implemented in order to maintain the pressure substantially constant at the level of the binder spraying nozzles or of the overpressure one of the modules. In a particular configuration, the engaging actuator of the tool and the binder supplying valve of both nozzles of a given module are controlled in parallel so that when the tool is stopped (or in a releasing position), the binder supply to the nozzles should also be stopped.

FIG. 2 shows the spreading device 3 in its spreading position, the control of the coupling device 4 having lowered it. In each module, a first nozzle 14 to the front and a second nozzle 15 to the back, for throwing binders on the roadway, surround the tool 13, for dispensing cut fibers on the roadway. The tools 13 are actuated through functional engagement on a shaft, the driving shaft 12 common to the different module and being in turn actuated by a motor 11 arranged in the device and receiving the power from the vehicle. The motor 11 is preferably hydraulic but in some alternatives, could be mechanical, pneumatic or electric, or even the like.

Each of the tools is removably mounted in its module between a releasing position where it is available to an operator outside the module and stopped and two positions where it is in the module: a working position where it is engaged and driven by the driving shaft and a rest position where it is stopped, being then no longer engaged. The removable mounting of the tool 13 occurs through rotation on a hinge 17, the tool being released from the module upwards tumbling for giving free access to the operator, to the back, to the rollers, cutting means, driving means and the like, the latter being on a tumbling tool frame, as can be subsequently seen in more detail on FIG. 6. When the tool is in the module (in working or rest position), the module is closed on all its faces except the inner face to the ground. By means of a second hinge within the tool, it is possible to have a working position (in functional engagement on the driving shaft) and a rest position (non engagement) while the tool is in the module and the module closed. Switching from the working position to the rest position, and inversely, occurs through implementing a controlled pneumatic actuator 16 acting on the tool so as to functionally or not engage it on the driving shaft 12. It should be noted that in a simplified alternative (not shown), one single hinge, of the type referenced as 17, could allow to achieve the three abovementioned position, releasing working and rest.

FIG. 3, a top schematic view of the machine, allows to find parts of the above described members.

FIG. 4 allows to more clearly see the spreading device 3 in a bottom view while the tools 13 are arranged in their modules. The transmission between the motor 11 and the driving shaft 12 preferably occurs through a belt although other means could be implemented (chain or gear) or that, even, the driving means is direct. The motor is preferably hydraulic as previously indicated.

FIG. 5 allows to more clearly see the spreading device 3 in a bottom view while the tools 13 are removed from the device 3. Actuators 16 can more particularly be seen allowing or not the functional engagement of the tool with the driving shaft 12. There can also be seen on the driving shaft 12, in each module, a member (of the rubber wheel type) allowing such a functional tool engagement. In addition, bearings (ball or preferably roller bearings) are implemented at the level of some of the separations between modules and at both ends of the device 3 for maintaining the driving shaft. The driving shaft 12 can be continuous across the device or not. The tools being available through tumbling, it is not required to dismantle the module in its entirety for performing repairs on the tools and a continuous driving shaft can thus be provided. However, in a more complex alternative (not shown), modules can be provided each comprising a driving shaft section with complementary engaging means at both ends of the section such that when both modules are joined together, both sections would be rotation engaged between one another.

FIG. 6 allows to see how the tool 13 in a module is pivotally mounted as it is illustrated in its releasing position, upwards tumbled and available for an operator and in its position inside the module in a working position.

Each of the tools of the modules comprises a fist axis 19 on which is located the part being engaged on the transmission member 12 through friction for transmitting the torque/rotation movement to a cutting roller. On said first axis 19, there is therefore mounted a cutting roller 20 with interchangeable blades. A rubber wheel (or any other material) is mounted interlocked with the transmission member 12 and this is by means of such a wheel that the cutting roller can be engaged. The tool further comprises on a second axis a pressing roller 21 mounted free in rotation allowing to hold the continuous fiber in contact with the cutting roller so as to allow it to be cut. The pressure of the pressing roller is ensured by a spring set system 23 allowing to compensate for the wear and the pressure setting. A holding roller 22 also mounted free in rotation on a third axis, allows to maintain the continuous fiber on the pressing roller 21 upstream the cutting roller 20 while avoiding the backwards release of the continuous fiber when the tool is at rest. The position of the holding roller 22 can be adjusted and it is mounted on a spring for compensating for the wear. Such members, axes and rollers, are mounted on a hinged support in 24 allowing, depending on its position, to place tool either in its working position or its rest position. Such a support is in turn hingedly mounted in 17 relative to the module frame so as to allow for the full tumbling of the tool outside the module in a tool releasing position for cleaning, maintenance or element replacement operations.

Preferably, pressurized air is directed in a part of the binder circuit in order to empty it and clean it at the end of a working site, more particularly with a view to prevent the nozzles from being clogged.

In other embodiments, the device could be associated to a specific trailer independent from the vehicle allowing it to be moved. In the latter case, the distribution of the associated members (binder tank, fluidizing means, pressurizing means, air compressor and pressurized air supply, continuous fiber supply) is achieved depending on the needs, from the trailer only comprising the spreading device with optionally the fiber supply, the other members being with the vehicle, up to the trailer comprising all such members. Similarly, the device being related to a spreading ramp could have a fixed or a variable width (telescopic or tumbling ramp type) optionally allowing for different spreading widths and a reduced space being used during conveying from one site to another. Similarly, the capacities of the tanks of binders, air and the like can be adapted depending on the machine, more particularly to larger volumes.

Finally, while the spreading device can be used for building or repairing traffic roadways (or the like) and wherein, in general, a subsequent coating is performed using granulates, it could also be implemented for building a primer layer being optionally structuring or, as well, be implemented for achieving a finish.

The invention claimed is:

1. A device (3) for simultaneously spreading cut fibers and binders on a roadway width, the device comprising, in the longitudinal from front to back direction, a first binder spreading set, a second cut fiber spreading set and a third binder spreading set, the second set comprising tools for cutting continuous fibers, said tools being driven by a torque transmission member, wherein the device is modular, the modules being arranged transversely side by side and each being adapted to spread on a longitudinal lane of the roadway binders and cut fibers, each module comprising from front to back:

for the first set, a first nozzle (14) for spreading binders, for the second set, a tool (13) for pulling continuous fibers, cutting continuous fibers and throwing the cut fibers to the roadway, for the third set, a second nozzle (15) for spreading binders, the first and the second nozzles being connected to a binder common dispensing member, the transmission member being a transversely arranged rotatively driving shaft (12) passing through said modules, each of the tools (13) being removably mounted in a said module between a working position wherein said tool is in the module and driven by the driving shaft, and a releasing position wherein said tool is available to an operator and at rest.

2. A device according to claim 1, wherein the tool comprises a first axis able to be rotatively engaged on the driving shaft and bearing a cutting roller, a second axis bearing a pressing roller for holding the continuous fiber in contact with the cutting roller and a third axis bearing a holding roller for holding the continuous fiber on the pressing roller upstream the cutting roller.

3. A device according to claim 1, wherein the length of the cut fibers can be set and the cut fiber flow rate can be adjusted through controlling the rotation speed of the driving shaft.

4. A device according to claim 1, wherein the tool is rotatively mounted in its module to provide a rest position wherein the tool being in the module, the tool is not driven by the driving shaft.

5. A device according to claim 4, wherein switching from the working position to the rest position occurs under the control of a remote controlled actuator (16) and the first and second nozzles comprise upstream from the common dispensing member side at least one remote controlled valve for cutting off or not the spreading of binders through both nozzles, the actuator and the valve control being common so as to allow or not simultaneously spreading cut fibers and binders for a given module.

6. A device according to claim 4, wherein the module comprises a first hinge (24) for switching the tool from the rest position to the working position and a second hinge (17) for switching the tool from the rest position to the releasing position.

7. A device according to claim 1, which further comprises at least two parts, one first part comprising a first module set and a second part comprising a second module set, both parts being movable one relative to the other between a large width mode and a reduced width mode.

8. A machine (1) for simultaneously spreading cut fibers and binders on a roadway width, said machine being an automotive road vehicle (2) with a driving and control (5) station, which comprises a device (3) according to claim 1 as well as at least: one binder tank (18), a means for fluidizing said binders, a means for pressurizing (6) said binders for directing towards the device nozzles, a continuous fiber supply (9), an air compressor and a pressurized air supply (7) for overpressurizing the modules, said vehicle providing power for actuating a torque transmission member of the device.

9. A machine according to claim 8, wherein the device is coupled to the machine by means of a controlled movable coupling device (4) allowing for a spreading position, the device being then close to the roadway, and a conveying position, the device being then away from the roadway.

10. A machine according to claim 9, wherein the controlled movable coupling device further allows for a lateral offset of the device relative to the vehicle.

11. A machine according to claim 8, wherein the means for pressurizing (6) said binders is a pump adapted to be set by a monitor for a pressure in the binder common dispensing member ranging in operation from about 0.5 $10^5$ to about 0.8 $10^5$ Pa.

12. A machine according to claim 8, wherein the vehicle has a spreading speed ranging from about 2 to about 5 km/h for dispensing cut fibers from 0 to 200 grams/$m^2$ of roadway and a binder flow rate ranging from about 0 to 3.5 liters/$m^2$.

13. A machine according to claim 8, wherein the means for fluidizing binders is a heating means.

14. A machine according to claim 8, which further comprises at least two parts, with a trailer coupled to the road vehicle comprising the driving and monitoring station, the trailer comprising at least the spreading device and the continuous fiber supply.

15. A device according to claim 1, wherein the tool comprises a first axis adapted to be rotatively engaged on the driving shaft and bearing a cutting roller, a second axis bearing a pressing roller for holding the continuous fiber in contact with the cutting roller and a third axis bearing a holding roller for holding the continuous fiber on the pressing roller upstream of the cutting roller.

16. A device according to claim 5, wherein the module comprises a first hinge (24) for switching the tool from the rest position to the working position and a second hinge (17) for switching the tool from the rest position to the releasing position.

* * * * *